US011889858B2

(12) United States Patent
Brifcani et al.

(10) Patent No.: US 11,889,858 B2
(45) Date of Patent: Feb. 6, 2024

(54) AEROSOL GENERATING ARTICLE COMPRISING A HOLLOW ROD OF AEROSOL GENERATING SUBSTRATE

(71) Applicant: Philip Morris Products S.A., Neuchatel (CH)

(72) Inventors: Noori Moyad Brifcani, Neuchatel (CH); Pascal Andre Daniel Jean Pratte, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 630 days.

(21) Appl. No.: 17/254,389

(22) PCT Filed: Jun. 20, 2019

(86) PCT No.: PCT/EP2019/066399
§ 371 (c)(1),
(2) Date: Dec. 21, 2020

(87) PCT Pub. No.: WO2019/243538
PCT Pub. Date: Dec. 26, 2019

(65) Prior Publication Data

US 2021/0267267 A1 Sep. 2, 2021

(30) Foreign Application Priority Data

Jun. 22, 2018 (EP) ..... 18179363

(51) Int. Cl.
*A24F 40/46* (2020.01)
*A24C 5/18* (2006.01)
(Continued)

(52) U.S. Cl.
CPC ..... *A24C 5/1885* (2013.01); *A24D 1/027* (2013.01); *A24D 1/20* (2020.01); *A24F 40/46* (2020.01); *A24F 40/20* (2020.01)

(58) Field of Classification Search
CPC ..... A24F 40/46; A24F 40/10; A24F 40/40; A24F 40/20; A24F 40/42; A24F 40/485; A24F 42/60; A24F 40/48
See application file for complete search history.

(56) References Cited

U.S. PATENT DOCUMENTS 2,349,551 A 5/1944 Helm
3,356,094 A * 12/1967 Ellis ..... A24D 1/002 131/273
(Continued)

FOREIGN PATENT DOCUMENTS

CN 104135881 A 11/2014
CN 204120237 U 1/2015
(Continued)

OTHER PUBLICATIONS

International Search Report and Written Opinion dated Oct. 7, 2019 in PCT/EP2019/066399 filed Jun. 20, 2019.
(Continued)

*Primary Examiner* — Truc T Nguyen
(74) *Attorney, Agent, or Firm* — Oblon, McClelland, Maier & Neustadt, L.L.P.

(57) ABSTRACT

An aerosol-generating article is provided for producing an inhalable aerosol when heated, the aerosol-generating article including: a hollow cylindrical rod of aerosol-generating substrate; a wrapper circumscribing the hollow cylindrical rod; and a hollow tube extending along a longitudinal axis of the hollow cylindrical rod and defining a central airflow channel of the aerosol-generating article, the hollow tube including a plurality of openings extending through a wall of the hollow tube, such that the aerosol-generating substrate in the hollow cylindrical rod is in fluid communication with the central airflow channel through the plurality of openings, and such that a ratio between a cumulative cross-sectional
(Continued)

area of the plurality of openings and a cross-sectional area of the central airflow channel is from about 0.042 to about 0.672.

13 Claims, 1 Drawing Sheet

(51) Int. Cl.

| | |
|---|---|
| ***A24D 1/20*** | (2020.01) |
| ***A24D 1/02*** | (2006.01) |
| *A24F 40/20* | (2020.01) |

(56) References Cited

U.S. PATENT DOCUMENTS

| | | | | |
|---|---|---|---|---|
| 4,027,679 | A | 6/1977 | Kaswan | |
| 6,883,523 | B2 | 4/2005 | Dante | |
| 7,827,994 | B2 | 11/2010 | Spiers et al. | |
| 8,235,056 | B2 | 8/2012 | Zhuang et al. | |
| 8,434,499 | B2 * | 5/2013 | Karles | A24D 3/041 131/338 |
| 9,138,016 | B2 * | 9/2015 | Luan | A24D 3/04 |
| 10,492,542 | B1 * | 12/2019 | Worm | A24F 40/50 |
| 10,668,058 | B2 * | 6/2020 | Rose | A24F 42/20 |
| 2005/0051185 | A1 * | 3/2005 | Rasouli | D21H 23/24 131/365 |
| 2006/0191546 | A1 | 8/2006 | Takano et al. | |
| 2008/0047571 | A1 * | 2/2008 | Braunshteyn | A24D 3/045 131/202 |
| 2015/0209530 | A1 * | 7/2015 | White | A24D 1/20 128/200.23 |
| 2018/0289073 | A1 * | 10/2018 | Guo | A61M 15/06 |
| 2019/0261684 | A1 | 8/2019 | Reevell | |
| 2020/0113243 | A1 * | 4/2020 | Novak, III | A61M 15/06 |
| 2023/0296549 | A1 * | 9/2023 | Yang | G01N 27/30 204/400 |

FOREIGN PATENT DOCUMENTS

| | | | |
|---|---|---|---|
| CN | 105212277 | A | 1/2016 |
| CN | 105682488 | A | 6/2016 |
| CN | 106418679 | A | 2/2017 |
| CN | 106455726 | A | 2/2017 |
| EP | 2 713 778 | B1 | 4/2016 |
| GB | 1083761 | A | 9/1967 |
| JP | 2017-518041 | A | 7/2017 |
| WO | WO 2004/089126 | A1 | 10/2004 |
| WO | WO 2012/164009 | A2 | 12/2012 |
| WO | WO 2014/140168 | A2 | 9/2014 |
| WO | WO 2015/166245 | A2 | 11/2015 |
| WO | WO 2015/197863 | A1 | 12/2015 |
| WO | WO 2016/023965 | A1 | 2/2016 |
| WO | WO 2017/051006 | A1 | 3/2017 |
| WO | WO 2017/207674 | A | 12/2017 |
| WO | WO 2018/095120 | A1 | 5/2018 |
| WO | WO 2019/037880 | A1 | 2/2019 |
| WO | WO 2019/037881 | A1 | 2/2019 |
| WO | WO 2019/037882 | A1 | 2/2019 |
| WO | WO 2019/037883 | A1 | 2/2019 |
| WO | WO 2019/110768 | A1 | 6/2019 |

OTHER PUBLICATIONS

Office Action dated Apr. 17, 2023 on the corresponding Japanese Patent Application No. 2020-568766 (with English Translation), 10 pages.

Combined Chinese Office Action and Search Report dated Sep. 5, 2022 in Chinese Patent Application No. 201980035766.4 (with English translation), 17 pages.

Combined Russian Office Action and Search Report issued on Oct. 3, 2022 in Russian Patent Application No. 2020139801 (with English translation), 16 pages.

Extended European Search Report dated Dec. 11, 2018 in European Patent Application No. 18179363.9, 9 pages.

* cited by examiner

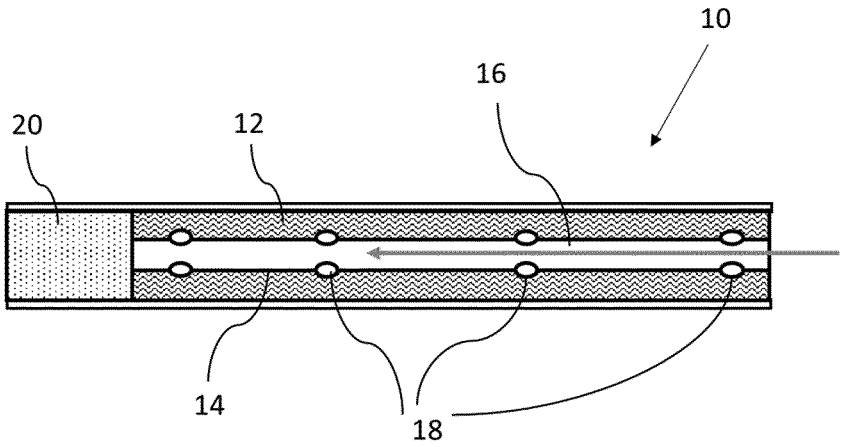
10
16
20
12
14
18

AEROSOL GENERATING ARTICLE COMPRISING A HOLLOW ROD OF AEROSOL GENERATING SUBSTRATE

The present invention relates to an aerosol generating article comprising an aerosol generating substrate.

Aerosol generating articles in which an aerosol generating substrate, such as a tobacco-containing substrate, is heated rather than combusted, are known in the art. Typically in such heated smoking articles, an aerosol is generated by the transfer of heat from a heat source to a physically separate aerosol generating substrate or material, which may be located in contact with, within, around, or downstream of the heat source. During use of the aerosol generating article, volatile compounds are released from the aerosol generating substrate by heat transfer from the heat source and are entrained in air drawn through the aerosol generating article. As the released compounds cool, they condense to form an aerosol.

Several alternative methods are available for producing substrates for heated aerosol generating articles, such as from randomly oriented shreds, strands, or strips of tobacco material. More recently, WO-A-2012/164009 has disclosed rods for heated aerosol generating articles formed from gathered sheets of homogenised tobacco material, which allow for a better control of porosity along the rods.

A number of prior art documents disclose aerosol generating devices for consuming aerosol generating articles. Such devices include, for example, electrically heated aerosol generating devices in which an aerosol is generated by the transfer of heat from one or more electrical heater elements of the aerosol generating device to the aerosol generating substrate of a heated aerosol generating article. The aerosol generating device may, for example, comprise a heating chamber adapted to removably receive an aerosol generating substrate that can be inserted by a user, and removed by the user after use. In such devices, the aerosol generating substrate may therefore receive heat from a surrounding surface of the heating chamber.

To facilitate insertion and removal of the aerosol generating article, an internal diameter of the heating chamber is preferably greater than an outer diameter of the aerosol generating article. This is also desirable in that it helps account for possible slight variations in the outer diameter of the aerosol generating article. By contrast, if an internal diameter of the heating chamber were very similar to an outer diameter of the aerosol generating article, fluctuations in the outer diameter of the aerosol generating article may prevent it from being inserted into the device, and in general portions of the aerosol generating article may be in direct contact or even pressed against heating surfaces, which may cause local overheating or even burning of the aerosol generating article.

Besides, it has been found that, in general, a smaller amount of aerosol generating substrate is needed in heated aerosol generating articles compared with aerosol generating articles wherein the substrate is combusted, such as conventional filter cigarettes. Thus, aerosol generating articles for producing an inhalable aerosol when heated may have a diameter similar to the diameter of a conventional filter cigarette, whilst being shorter than a conventional filter cigarette. Aerosol generating articles for producing an inhalable aerosol when heated may have roughly the same length of a conventional filter cigarette, whilst being slimmer than a conventional filter cigarette.

Aerosol generating articles of the slimmer type can be heated quickly, as there is less material to heat per length unit. Further, it may be possible to independently heat different longitudinal portions of the aerosol generating substrate in succession, which may enable a fine management of how the aerosol generating substrate is consumed over time.

However, slimmer aerosol generating articles are less suitable for use with an internal heating mechanism, which is one where a heating element, such as a heater blade, is inserted into the aerosol generating substrate. This is because insertion of the heating element into the aerosol generating substrate may damage the substrate or the heating element itself.

When used in a device comprising a heating chamber adapted to receive the aerosol generating article, though, slimmer aerosol generating articles are more prone to sliding out of the heating chamber and are typically not held in an ideally centred position within the heating chamber, and so the supply of thermal energy to the aerosol generating substrate may not be as homogenous as possible. In addition, because heat is supplied from the periphery of the aerosol generating article, the outer portion of the substrate may become overheated in an attempt to also supply heat to the central portion of the substrate, or there may be a general reduction in the overall thermal efficiency.

It would be desirable to provide an alternative aerosol generating article that is easier to heat efficiently, such that most of the aerosol generating substrate is efficiently brought to the desired temperature without overheating or otherwise wasting thermal energy.

The present disclosure relates to an aerosol generating article for producing an inhalable aerosol when heated, the aerosol generating article comprising: a hollow cylindrical rod of aerosol generating substrate; a wrapper circumscribing the rod; a hollow tube extending along a longitudinal axis of the rod and defining a central airflow channel of the aerosol generating article. The hollow tube comprises at least one opening extending through a wall of the tube, such that the aerosol generating substrate in the rod is in fluid communication with the central airflow channel through the opening. A cross-sectional surface area of the central airflow channel is from about 3.14 square millimetres to about 4.52 square millimetres; and a cross-sectional area of the at least one opening is from about 0.19 square millimetres to about 0.38 square millimetres.

Further, the present disclosure relates to an aerosol generating article for producing an inhalable aerosol when heated, the aerosol generating article comprising: a hollow cylindrical rod of aerosol generating substrate; a wrapper circumscribing the rod; a hollow tube extending along a longitudinal axis of the rod and defining a central airflow channel of the aerosol generating article. The hollow tube comprises at least one opening extending through a wall of the tube, such that the aerosol generating substrate in the rod is in fluid communication with the central airflow channel through the opening. A ratio between a cross-sectional area of the at least one opening and a cross-sectional area of the central airflow channel is from about 0.042 to about 0.121.

According to an aspect of the present invention there is provided an aerosol generating article for producing an inhalable aerosol when heated, the aerosol generating article comprising: a hollow cylindrical rod of aerosol generating substrate; a wrapper circumscribing the rod; a hollow tube extending along a longitudinal axis of the rod and defining a central airflow channel of the aerosol generating article. The hollow tube comprises a plurality of openings extending through a wall of the tube, such that the aerosol generating substrate in the rod is in fluid communication with the central airflow channel through the openings. A ratio between a cumulative cross-sectional area of the plurality of openings and a cross-sectional area of the central airflow channel is from about 0.042 to about 0.672.

According to a further aspect of the present invention there is provided an aerosol generating system comprising an aerosol generating article and an electrically operated aerosol generating device comprising a heater and an elongate heating chamber configured to receive the aerosol generating article so that the aerosol generating article is heated in the heating chamber, wherein the aerosol generating article comprises: a hollow cylindrical rod of aerosol generating substrate; a wrapper circumscribing the rod; a hollow tube extending along a longitudinal axis of the rod and defining a central airflow channel of the aerosol generating article. The hollow tube comprises at least one opening extending through a wall of the tube, such that the aerosol generating substrate in the rod is in fluid communication with the central airflow channel through the opening.

It will be appreciated that any features described with reference to one aspect of the present invention are equally applicable to any other aspect of the invention.

As used herein, the term "heated aerosol generating article" refers to an aerosol generating article for producing an aerosol comprising an aerosol generating substrate that is intended to be heated rather than combusted in order to release volatile compounds that can form an aerosol. A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material.

As used herein, the term "aerosol generating substrate" refers to a substrate capable of releasing upon heating volatile compounds, which can form an aerosol. The aerosol generated from aerosol generating substrates of aerosol generating articles described herein may be visible or invisible and may include vapours (for example, fine particles of substances, which are in a gaseous state, that are ordinarily liquid or solid at room temperature) as well as gases and liquid droplets of condensed vapours.

As used herein, the term "rod" refers to a generally cylindrical element of substantially polygonal cross-section and preferably of circular, oval or elliptical cross-section.

As used herein, the term "hollow tube" denotes a hollow elongate element defining a lumen or airflow passage along a longitudinal axis thereof.

As used herein, the term "longitudinal" refers to the direction corresponding to the main longitudinal axis of the aerosol generating article, which extends between the upstream and downstream ends of the aerosol generating article. During use, air is drawn through the aerosol generating article in the longitudinal direction. The term "transverse" refers to the direction that is perpendicular to the longitudinal axis.

Any reference to the "cross-section" of the aerosol generating article or a component of the aerosol generating article refers to the transverse cross-section unless stated otherwise. A "cross-sectional area" of the aerosol generating article or of a component of the aerosol generating article is the surface area the cross-section of the article or component thereof as measured in a plane substantially perpendicular to the longitudinal axis of the article or component.

As used herein, the term "length" refers to the dimension of a component in the longitudinal direction and the term "width" refers to the dimension of a component in the transverse direction. For example, in the case of a rod having a circular cross-section, the maximum width correspond to the diameter of the circle.

As used herein, the terms "upstream" and "downstream" describe the relative positions of elements, or portions of elements, of the aerosol generating article in relation to the direction in which the aerosol is transported through the aerosol generating article during use.

The term "equivalent diameter" is used herein to denote the diameter of the circle which has the same surface area as the transverse cross-section of an element, such as an opening in the hollow tube. In general, the transverse cross-section of an opening in the hollow tube may have any shape, although a circular or quasi-circular shape, such as an oval or elliptic shape is preferred. For an opening having a circular transverse cross-section, the equivalent diameter is the diameter of the cross-section of the opening.

As briefly described above, the aerosol generating article of the present invention incorporates a hollow cylindrical rod of aerosol generating substrate and a wrapper circumscribing the rod. A hollow tube extends along a longitudinal axis of the rod and defines a central airflow channel of the aerosol generating article. The hollow tube comprises at least one opening extending through a wall of the tube, such that the aerosol generating substrate in the rod is in fluid communication with the central airflow channel through the opening or openings. A ratio between a cumulative cross-sectional area of the plurality of openings and a cross-sectional area of the central airflow channel is from about 0.042 to about 0.672.

Because the aerosol generating substrate occupies the periphery of the aerosol generating article, it is easy to heat substantially only the aerosol generating substrate when heat is supplied by convection in the radial direction from the wall of a heating chamber into which the aerosol generating article is received. This minimises the potential for energy lost to a central core of the aerosol generating substrates, which in known aerosol generating article, may at times fail to reach an appropriate temperature for optimal aerosol formation and delivery to the consumer.

Further, by establishing a fluid communication between the aerosol forming substrate and the airflow channel defined by the hollow tube, and by adjusting the size and number of the openings formed through the wall of the hollow tube or the size of the hollow tube or both, it is advantageously possible to control the aerosolization process by effectively controlling the airflow of the heated vapours as they condense to form the inhalable aerosol. When the consumer draws on an end of the aerosol generating article to draw aerosol from the article, the openings formed in the wall of the hollow tube enable flow of the heated vapours into the mainstream airflow travelling along the central airflow channel. This advantageously leads to a fuller aerosol volume.

In addition, by adjusting the size and number of the openings formed through the wall of the hollow tube or the size of the hollow tube or both, as well as by providing the openings at different locations along the length of the hollow tube and about the periphery of the hollow tube, it is also advantageously possible to control the overall RTD of the aerosol generating article such that it provides the consumer with an experience similar to drawing on a conventional cigarette.

The aerosol generating substrate provided in the hollow cylindrical rod of aerosol generating articles in accordance with the invention may be formed from shreds, strands, or strips of tobacco material, including sheets of reconstituted tobacco or homogenised tobacco. As used herein, the term "homogenised tobacco material" encompasses any tobacco material formed by the agglomeration of particles of tobacco material. Sheets or webs of homogenised tobacco material are formed by agglomerating particulate tobacco obtained by grinding or otherwise powdering of one or both of tobacco leaf lamina and tobacco leaf stems. In addition, homogenised tobacco material may comprise one or more of tobacco dust, tobacco fines, and other particulate tobacco by-products formed during the treating, handling and shipping of tobacco as well as binder, aerosol formers, flavours, other non-tobacco materials, like other plant material, including fibres and others. The sheets of homogenised tobacco material may be produced by casting, extrusion, paper making processes or other any other suitable processes known in the art.

The continuous sheet of aerosol forming material may be a smooth sheet. The continuous sheet may be treated to facilitate the gathering of the sheet. For example, the continuous sheet may be grooved, creased, folded, textured, embossed, or otherwise treated to provide lines of weakness to facilitate gathering. A preferred treatment for the continuous sheet is crimping. As used herein, the term "crimped" denotes a sheet having a plurality of substantially parallel ridges or corrugations. The inclusion of one or more crimped sheets may help to retain the spacing between adjacent sheets within the rod.

The sheets may be formed of a porous tobacco material. The term "porous" is used herein to refer to a material that provides a plurality of pores or openings that allow the passage of air through the material. The tobacco material may be produced within an inherent porosity so that sufficient pores or interstices are provided within the structure of each sheet to enable the flow of air through the sheet in a longitudinal direction. Alternatively or in addition, each sheet of tobacco material may comprise a plurality of air flow holes to provide the desired porosity. For example, the sheet of tobacco material may be punctured with a pattern of air flow holes during production of the rod of aerosol generating substrate. The air flow holes may be punctured randomly or uniformly over the sheet. The pattern of air flow holes may cover substantially the full surface of the sheet, or may cover one or more specific areas of the sheet, with the remaining areas being free from air flow holes.

The shreds, strands or strips of tobacco material may be randomly arranged within the rod. As an alternative, the shreds, strands or strips of tobacco material may be substantially parallel and aligned with a longitudinal axis of the rod.

Preferably the aerosol generating substrate comprises an aerosol-former. As used herein, the term "aerosol former" describes any suitable known compound or mixture of compounds that, in use, facilitates formation of an aerosol and that is substantially resistant to thermal degradation at the operating temperature of the aerosol generating article. Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as propylene glycol, triethylene glycol, 1,3-butanediol and, most preferred, glycerine.

The aerosol former may be provided as a liquid or a gel. In some embodiments, the aerosol former may be provided in a composition further comprising nicotine or a flavourant or both.

Homogenised tobacco materials may further include various other additives such as humectants, plasticisers, flavourants, fillers, binders and solvents.

In the hollow cylindrical rod of articles in accordance with the present invention the aerosol generating substrate occupies an annular space substantially extending from the outer surface of the hollow tube defining the central airflow channel and the inner surface of the wrapper. A cross-section of the hollow cylindrical rod is substantially annulus-shaped. In preferred embodiments, the cross-section of the hollow cylindrical rod is substantially ring-shaped and defines a region bounded by two concentric circles. Thus, an external diameter and an internal diameter can be identified for the hollow cylindrical rod that correspond to the diameters of the two concentric circles. The term "radial thickness" of the hollow cylindrical rod is used herein to denote the difference between the external diameter and the internal diameter of the cross-section of the hollow cylindrical rod.

The hollow rod of aerosol generating substrate preferably has an external diameter that is approximately equal to the external diameter of the aerosol generating article.

Preferably, the rod of aerosol generating substrate has an external diameter of at least 5 millimetres. The rod of aerosol generating substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol generating substrate has an external diameter of 7.3 millimetres, to within 10 percent.

The rod of aerosol generating substrate may have a length of between about 5 millimetres and about 100 mm. Preferably, the rod of aerosol generating substrate has a length of at least about 5 millimetres, more preferably at least about 7 millimetres. In addition, or as an alternative, the rod of aerosol generating substrate preferably has a length of less than about 75 millimetres, more preferably less than about 50 millimetres. In one embodiment, the rod of aerosol generating substrate may have a length of about 40 millimetres. In a preferred embodiment, the rod of aerosol generating substrate has a length of about 43 millimetres.

Preferably, the rod of aerosol generating substrate has a substantially uniform cross-section along the length of the rod. Particularly preferably, the rod of aerosol generating substrate has a substantially annular cross-section, the internal and outer diameters of the annulus being substantially constant along the longitudinal axis of the hollow rod.

A radial thickness of the annulus of aerosol generating substrate will generally also depend on the size of the hollow tube defining the central airflow channel, as will be described in more detail below. In preferred embodiments, a radial thickness of the annulus of aerosol generating substrate is at least about 2 millimetres. Even more preferably, a radial thickness of the annulus of aerosol generating substrate is at least about 2.2 millimetres.

As described briefly above, in the aerosol generating articles of the present invention, the aerosol generating substrate is circumscribed by a wrapper. The wrapper may be formed of a porous or non-porous sheet material. The wrapper may be formed of any suitable material or combination of materials. Preferably, the wrapper is a paper wrapper.

In some embodiments, the wrapper circumscribes only the rod. In other embodiments, where the aerosol-generating article comprises one or more additional components in substantial alignment with the rod, the wrapper may at least partly circumscribe the one or more additional components, as well. In practice, the rod and any additional component may be assembled within the same wrapper. For example, aerosol generating articles according to the invention may further comprise at least one of: a mouthpiece, an aerosol cooling element and a support element such as a hollow acetate tube. For example, in one preferred embodiment, an aerosol generating article comprises, in linear sequential arrangement, a rod of aerosol generating substrate as described above, a support element located immediately downstream of the aerosol-generating substrate, an aerosol cooling element located downstream of the support element, the wrapper circumscribing the rod, the support element and the aerosol cooling element.

In addition, or as an alternative, the aerosol generating article may comprise a mouthpiece filter or a hollow tube segment defining a mouth-end cavity, or both. The filter may be located at the downstream end of the aerosol-generating article. The filter may be a cellulose acetate filter plug. The filter is approximately 7 mm in length in a preferred embodiment, but may have a length of between approximately 5 mm and approximately 10 mm.

The hollow tube may be formed from a polymeric material or a paper material. For example, the hollow tube segment can be formed from an extruded plastic tube. As an alternative, the hollow tube segment may be formed from a plurality of overlapping paper layers, such as a plurality of parallel wound paper layers or a plurality of spirally wound paper layers. Forming the hollow tube segment from a plurality of overlapping paper layers can help improve the resistance of a paper based hollow tube to collapse or deformation. Preferably one such hollow tube comprises at least two paper layers. Alternatively, or additionally, the hollow tube preferably comprises fewer than eleven paper layers.

An exemplary method for forming a hollow tube from a plurality of wound paper layers comprises wrapping a plurality of substantially continuous paper strips in an overlapping manner about a cylindrical mandrel. The strips are wrapped in a parallel manner or a spiral manner so as to form a substantially continuous tube on the mandrel. The formed tube may be turned about the mandrel, for example using a rubber belt, so that the paper layers are continually drawn and wrapped around the mandrel. The formed tube can then be cut into the required lengths downstream of the mandrel.

Preferably, the aerosol generating article comprises a plurality of openings formed into the wall of the hollow tube.

In preferred embodiments, the at least one opening comprises at least a first row of openings spaced about the circumference of the hollow tube at a predetermined distance from a first end of the hollow tube. This is advantageous in that it facilitates a more homogenous transfer of the heated vapours from the aerosol forming substrate into the central airflow channel, which in turn may lead to a more homogeneous distribution of the condensed aerosol species in the flow inhaled by the consumer.

In preferred embodiments, the at least one opening comprises at least a second row of openings spaced about the circumference of the hollow tube, the second row of openings being longitudinally spaced from the first row of openings by at least about 1 centimetre. This advantageously makes it easier for the aerosol forming substrate to be used as a source of aerosol species in its entirety.

In some alternative embodiments, a plurality of openings are formed in the wall of the hollow tube, the openings being arranged helically about an outer surface of the hollow tube. This alternative arrangement may also enable an efficient use of the entirety of the aerosol forming substrate.

An outer diameter of the hollow tube is preferably at least about 2.0 millimetres. More preferably, an outer diameter of the hollow tube is at least about 2.1 millimetres.

In addition, or as an alternative, the outer diameter of the hollow tube is preferably from less than about 3 millimetres. More preferably, the outer diameter of the hollow tube is less than about 2.8 millimetres. Even more preferably, the outer diameter of the hollow tube is less than about 2.5 millimetres.

In particularly preferred embodiments, an outer diameter of the hollow tube is preferably from about 2.0 millimetres to about 2.5 millimetres.

Preferably, a wall thickness of the hollow tube is at least about 0.2 millimetres. More preferably, a wall thickness of the hollow tube is at least about 0.4 millimetres. A wall thickness of the hollow tube may be less than about 1 millimetre. More preferably, a wall thickness of the hollow tube is less than about 0.8 millimetres. In particularly preferred embodiments, a wall thickness of the hollow tube is from about 0.2 millimetres to about 1 millimetre, even more preferably from about 0.4 millimetres to about 0.8 millimetres.

Preferably an equivalent diameter of the opening or openings is at least about 0.5 millimetres. In addition, or as an alternative, an equivalent diameter of the opening or openings is less than about 0.7 millimetres. It has been found that the pressure drop associated with openings having an equivalent diameter falling within this range is such that during use the heated vapour species are easily drawn into the central airflow channel defined by the hollow tube.

In preferred embodiments, the hollow tube has a resistance-to-draw (RTD) of at least about 60 millimetres $H_2O$. More preferably, the hollow tube has a resistance-to-draw (RTD) of at least about 70 millimetres $H_2O$. Even more preferably, the hollow tube has a resistance-to-draw (RTD) of at least about 80 millimetres $H_2O$.

According to another example, an aerosol generating article for producing an inhalable aerosol when heated comprises: a hollow cylindrical rod of aerosol generating substrate; a wrapper circumscribing the rod; a hollow tube extending along a longitudinal axis of the rod and defining a central airflow channel of the aerosol generating article, the hollow tube comprising at least one opening extending through a wall of the tube, such that the aerosol generating substrate in the rod is in fluid communication with the central airflow channel through the opening. A ratio between a cross-sectional area of the at least one opening and a cross-sectional area of the central airflow channel is from about 0.042 to about 0.121.

Preferably, a ratio between a cross-sectional area of the at least one opening and a cross-sectional area of the central airflow channel is at least about 0.05. More preferably, a ratio between a cross-sectional area of the at least one opening and a cross-sectional area of the central airflow channel is at least about 0.07. In addition, or as an alternative, a ratio between a cross-sectional area of the at least one opening and a cross-sectional area of the central airflow channel is preferably less than about 0.10. More preferably, a ratio between a cross-sectional area of the at least one opening and a cross-sectional area of the central airflow channel is less than about 0.08.

As explained above, according to an aspect of the present invention an aerosol generating article for producing an inhalable aerosol when heated comprises a hollow cylindrical rod of aerosol generating substrate; a wrapper circumscribing the rod; a hollow tube extending along a longitudinal axis of the rod and defining a central airflow channel of the aerosol generating article. The hollow tube comprises a plurality of openings extending through a wall of the tube, such that the aerosol generating substrate in the rod is in fluid communication with the central airflow channel through the openings. A ratio between a cumulative cross-sectional area of the plurality of openings and a cross-sectional area of the central airflow channel is from about 0.042 to about 0.672.

Without wishing to be bound by theory, it is understood that the pressure drop associated with a cylindrical or quasi-cylindrical conduit is inversely proportional to the square of the equivalent diameter of the conduit (as suggested by the Hagen-Poiseuille equation). As such, the pressure drop associated with each opening in the wall of the hollow tube, as well as the pressure drop across the central airflow channel can be considered to be inversely proportional to the cross-sectional area of each opening and of the hollow tube, respectively. The inventors have found that when a ratio between the cross-sectional area of a single opening in the wall of the hollow tube and the cross-sectional area of the central airflow channel, particularly advantageous fluid dynamics conditions are set during use of an aerosol generating article, such that the heated vapours species are easily drawn into the central airflow channel and mixed with the mainstream airflow upon a consumer's inhalation. This also extends to certain ratios between the cumulative cross-sectional areas of all the openings formed in the wall of the hollow tube and the cross-sectional area of the central airflow channel defined by the hollow tube.

Further, aerosol generating articles having openings and a hollow tube sized such as to fall within the ranges described above desirably have an overall RTD adapted to provide the consumer with an experience closely comparable to drawing on a conventional cigarette.

According to another aspect of the present invention, an aerosol generating system is provided that comprises an aerosol generating article of the type described above. In more detail, one such system comprises an electrically operated aerosol generating device comprising a heater and an elongate heating chamber configured to receive the aerosol generating article so that the aerosol generating article is heated in the heating chamber.

Preferably, the heater comprises a substantially cylindrical, elongate heating element and the heating chamber is disposed about a circumferential, longitudinal surface of the heater. Accordingly, during use, the thermal energy supplied by the heater travels radially outwards from a surface of the heater into the heating chamber and the aerosol generating article. The thermal energy supplied by the heater only needs to reach the outer surface of the hollow tube in order to efficiently heat the aerosol generating substrate, and so it is easy to use the heat generated by the device more efficiently.

However, other shapes and configurations of the heater and heating chamber can alternatively be used.

The heater may comprise a plurality of individual heating elements, the various heating elements being operable independently of one another so that different elements can be activated at different times to heat the aerosol generating article. By way of example, the heater may comprise a plurality of axially aligned heating elements, which provide a plurality of independent heating zones along the length of the heater. Each heating element may have a length significantly less than the overall length of the heater. Thus, when one individual heating element is activated, it supplies thermal energy to a portion of the aerosol generating substrate located radially in the vicinity of the heating element without substantially heating the remainder of the aerosol generating substrate. Thus, different sections of the aerosol generating substrate may be heated independently and at different times.

As an alternative, or in addition, the heater may comprise a plurality of elongate, longitudinally extending heating elements at different locations around the longitudinal axis of the heater. Thus, when one individual heating element is activated, it supplied thermal energy to a longitudinal portion of the aerosol generating substrate lying substantially parallel and adjacent to the heating element. This arrangement also allows for the independent heating of the aerosol generating substrate in distinct portions.

In preferred embodiments, the aerosol generating system further comprises an insulation means arranged between the heating chamber and an exterior of the apparatus to reduce heat loss from heated aerosol generating substrate.

The invention will now be further described with reference to the drawing of FIG. 1, which shows a schematic longitudinal cross-sectional view of an aerosol generating article in accordance with the present invention.

The aerosol generating article 10 shown in FIG. 1 comprises a hollow cylindrical rod 12 of aerosol generating substrate circumscribed by a paper wrapper 14. The rod 12 comprises a plurality of strands or strips of homogenised tobacco material substantially randomly arranged within the rod. The strands have a width of about 1.4 millimetres and a length of at least about 10 millimetres. An external diameter of the rod 12 is about 7.4 millimetres. An internal diameter of the rod is about 4.2 millimetres. A length of the rod 12 is about 50 millimetres. Further, the aerosol generating article 10 comprises a hollow tube 14 made of a polymeric material extending along a longitudinal axis of the rod and defining a central airflow channel 16 of the aerosol generating article. The hollow tube 14 has an external diameter of about 4.2 millimetres and a wall thickness of about 1 millimetre. Thus, an internal diameter of the hollow tube is about 2.2 millimetres, and a cross-sectional area of the central airflow channel is about 3.8 square millimetres.

The hollow tube comprises a plurality of openings 18 extending through the wall of the tube, which establish fluid communication between the aerosol generating substrate in the rod 12 and the central airflow channel 16. Each opening 18 has a diameter of about 0.6 millimetre, and a cross-section of about 0.28 square millimetres. Thus, a ratio between the area of the cross-section of each single opening 18 and the area of the cross-section of the central airflow channel 16 is about 0.073.

The openings 18 are provided as four pairs of openings located at diametrically opposed locations about the periphery of the hollow tube 14. Adjacent pairs of openings are longitudinally spaced about 9 millimetres from each other. The cumulative cross-sectional area of the eight openings 18 is about 2.24 square millimetres. Thus, a ratio between the cumulative cross-sectional area of the openings 18 and the area of the cross-section of the central airflow channel 16 is about 0.59.

At the downstream end, the aerosol generating article 10 comprises a filter 20.

In use, the aerosol generating article 10 described above is received in an elongate heating chamber of an electrically operated aerosol generating device comprising a heater configured to supply heat to the aerosol generating article in the heating chamber. To this purpose, the heater may comprise a substantially cylindrical, elongate heating element, the heating chamber being disposed about a circumferential, longitudinal surface of the heater. The consumer draws on the mouth end of the aerosol generating article, and air is drawn into the aerosol generating article at the opposite end. The arrow in FIG. 1 indicates schematically a direction of flow of a mainstream airflow travelling along the central airflow channel 16.

The invention claimed is:

1. An aerosol-generating article for producing an inhalable aerosol when heated, the aerosol-generating article comprising:

a hollow cylindrical rod of aerosol-generating substrate;

a wrapper circumscribing the hollow cylindrical rod; and a hollow tube extending along a longitudinal axis of the hollow cylindrical rod and defining a central airflow channel of the aerosol-generating article, the hollow tube comprising a plurality of openings extending through a wall of the hollow tube, such that the aerosol-generating substrate in the hollow cylindrical rod is in fluid communication with the central airflow channel through the plurality of openings, wherein a ratio between a cumulative cross-sectional area of the plurality of openings and a cross-sectional area of the central airflow channel is from about 0.042 to about 0.672.

2. The aerosol-generating article according to claim 1, wherein at least one opening of the plurality of openings comprises at least a first row of openings spaced about a circumference of the hollow tube at a predetermined distance from a first end of the hollow tube.

3. The aerosol-generating article according to claim 2, wherein the at least one opening further comprises at least a second row of openings spaced about the circumference of the hollow tube, the second row of openings being longitudinally spaced from the first row of openings by at least about 1 cm.

4. The aerosol-generating article according to claim 1, wherein the plurality of openings are arranged helically about an outer surface of the hollow tube.

5. The aerosol-generating article according to claim 1, wherein an outer diameter of the hollow tube is from about 2.0 mm to about 2.5 mm.

6. The aerosol-generating article according to claim 1, wherein an equivalent diameter of an opening among the plurality of openings is from about 0.5 mm to about 0.7 mm.

7. The aerosol-generating article according to claim 1, wherein a thickness of the hollow tube is from about 0.4 mm to about 1 mm.

8. The aerosol-generating article according to claim 1, wherein the hollow tube has a resistance-to-draw (RTD) of at least about 60 mm $H_2O$.

9. The aerosol-generating article according to claim 1, wherein the at least one opening has a resistance-to-draw (RTD) less than 50 percent of the RTD of the hollow tube.

10. An aerosol-generating system, comprising:

an aerosol-generating article and an electrically operated aerosol-generating device, the electrically operated aerosol-generating device comprising a heater and an elongate heating chamber configured to receive the aerosol-generating article such that the aerosol-generating article is heated in the elongate heating chamber, and the aerosol-generating article comprising:

a hollow cylindrical rod of aerosol-generating substrate, a wrapper circumscribing the hollow cylindrical rod, and a hollow tube extending along a longitudinal axis of the hollow cylindrical rod and defining a central airflow channel of the aerosol-generating article, the hollow tube comprising at least one opening extending through a wall of the hollow tube, such that the aerosol-generating substrate in the hollow cylindrical rod is in fluid communication with the central airflow channel through the at least one opening.

11. The aerosol-generating system according to claim 10, wherein a cross-sectional surface area of the central airflow channel is from about 3.14 $mm^2$ to about 4.52 $mm^2$, and wherein a cross-sectional area of the at least one opening is from about 0.19 $mm^2$ to about 0.38 $mm^2$.

12. The aerosol-generating system according to claim 10, wherein the heater comprises a substantially cylindrical, elongate heating element, and the elongate heating chamber is disposed about a circumferential, longitudinal surface of the heater.

13. The aerosol-generating system according to claim 10, further comprising insulation arranged between the heating chamber and an exterior of the system configured to reduce heat loss from the aerosol-generating substrate when the aerosol-generating substrate is heated.

* * * * *